United States Patent [19]

Lemper

[11] Patent Number: 4,687,046

[45] Date of Patent: Aug. 18, 1987

[54] TOP ROLLER APRON IN A CONTINUOUS CASTING ASSEMBLY

[75] Inventor: Herbert Lemper, McMurray, Pa.

[73] Assignee: Kabushiki Kaisha Kobe Seiki Sho, Kobe, Japan

[21] Appl. No.: 835,786

[22] Filed: Mar. 3, 1986

[51] Int. Cl.[4] ..... B22D 11/12; B22D 11/128

[52] U.S. Cl. ..... 164/442; 164/448; 72/211; 72/237; 29/115

[58] Field of Search ..... 164/442, 448; 72/168, 72/211, 224, 234, 237; 29/115

[56] References Cited

U.S. PATENT DOCUMENTS

| | | | |
|---|---|---|---|
| 3,167,829 | 2/1965 | Hess et al. | 164/442 |
| 3,262,162 | 7/1966 | Lemper | 164/445 |
| 3,268,956 | 8/1966 | Lemper | 164/442 |
| 3,278,999 | 10/1966 | Lemper | 164/416 |
| 3,318,368 | 5/1967 | Lemper | 164/442 |
| 3,442,145 | 5/1969 | Lemper | 164/416 |
| 3,442,322 | 5/1969 | Lemper | 164/445 |
| 3,453,914 | 7/1969 | Lemper et al. | 164/416 |
| 3,542,117 | 11/1970 | Lemper et al. | 164/416 |
| 3,550,675 | 12/1970 | Hess et al. | 164/442 |
| 3,559,441 | 2/1971 | Lemper et al. | 164/448 |
| 3,585,831 | 6/1971 | Lemper | 164/448 |
| 3,670,587 | 6/1972 | Lemper | 164/448 |
| 3,680,400 | 8/1972 | Lemper et al. | 164/416 |
| 3,727,673 | 4/1973 | Gallucci | 164/442 |
| 3,735,848 | 5/1973 | Bode, Jr. et al. | 164/448 |
| 3,739,618 | 6/1973 | Lemper | 164/448 |
| 3,765,210 | 10/1973 | Lemper | 164/448 |
| 3,891,026 | 6/1975 | Reinfeld et al. | 164/442 |
| 4,228,844 | 10/1980 | Scheurecker | 164/442 |

FOREIGN PATENT DOCUMENTS

| | | | |
|---|---|---|---|
| 1294603 | 5/1969 | Fed. Rep. of Germany | 164/448 |
| 1303271 | 8/1971 | Fed. Rep. of Germany | 442/ |
| 1086469 | 10/1967 | United Kingdom | 164/448 |
| 597498 | 2/1978 | U.S.S.R. | 164/442 |

*Primary Examiner*—Nicholas P. Godici
*Assistant Examiner*—Samuel M. Heinrich
*Attorney, Agent, or Firm*—Oblon, Fisher, Spivak, McClelland & Maier

[57] ABSTRACT

A top roller apron in a continuous casting assembly, including a back face side frame, an inside face side frame, and a pair of narrow-face frames positioned on both sides of the side frames, a plurality of rolls mounted side by side to each of the side frames, wherein the back face side and inside face side frames each include unit roll frames, the unit roll frames being arranged in series in a casting direction and each supporting an single roll and wherein opposite end portions of each said roll frame are removably attached to side walls of the paired narrow-face frames.

8 Claims, 6 Drawing Figures

TOP ROLLER APRON IN A CONTINUOUS CASTING ASSEMBLY

BACKGROUND OF THE INVENTION

1. Field of the Invention

The present invention relates to a top roller apron for guiding a cast strip under a mold with a slight clearance in a continuous casting assembly.

2. Description of the Prior Art

A top roller apron in a conventional continuous casting assembly is composed of a back face frame, an inside face frame and a pair of narrow-face frames. In the case of a two-faced roll type, a roll-bearing housing assembly is attached to the back face and inside face frames and a shim is disposed under the bearing housing, whereby each roll is so adjusted as to lie along back face side and inside face side circular arcs (see, for example, U.S. Pat. No. 4,131,154 corresponding to JP-B2-No. 3453/1982).

In the case of a four-faced roll type, a roll-bearing housing assembly is attached to an additional pair of narrow-faced frames and a shim is disposed under the bearing housing, whereby the level of each roll is adjusted. The frames are each positioned with a key and are fixed in the form of a framework through tie rods, and the roll gap is adjusted with a shim disposed between the paired narrow-faced frames and the adjustable frame.

In the top roller apron there occur various phenomena such as slag inclusion, abnormal wear and corrosion caused by the influence of flux and roll deformation, as well as break-out damage. As a result, it is sometimes necessary to replace only one roll before replacement of the entire top roller apron.

At the time of such maintenance it is necessary to first disassemble all the frames and thereafter replace the roll in question. Thus the operation is particularly troublesome since disassembly results in a potential loss of alignment of the rolls. Moreover, since the alignment of the conventional top roller apron is adjusted with a shim disposed between the apron and a support bed of the equipment, it is necessary to lift the top roller apron from the support bed, but this operation creates difficulties because of limited working space.

SUMMARY OF THE INVENTION

It is an object of the present invention to provide a top roller apron in a continuous casting assembly capable of replacing any individual roll or group of rolls easily without disassembling the frames.

It is another object of the present invention to provide a top roller apron in a continuous casting assembly capable of being easily adjusted for alignment.

According to the present invention, in order to achieve the first object there is provided a top roller apron in a continuous casting assembly, including a back face-side frame and an inside face frame which are constituted by arranging unit roll frames such that each support a single roll, in series in a casting direction, with opposite end portions of each roll frame being removably attached to outer surfaces of a pair of narrow-face frames.

In order to achieve the second object there is provided, according to a second embodiment, a top roller apron in a continuous casting assembly, which includes back face frame, an inside face frame and a pair of narrow-face frames and in which there are provided a support portion for supporting the paired narrow-face frames to the equipment body frame as well as tilting means and parallel moving means for respectively tilting the top roller apron and moving it horizontally toward the back face side and inside face side, through said support portion.

According to the present invention, since the back face and adjusting inside face frames are composed of unit roll frames, it is possible to change rolls each individually and thus the roll changing operation is facilitated and easier alignment is thus possible so as to allow for better alignment, better slab quality and fewer breakouts. Moreover, since a shim or the like is disposed between each unit roll frame and each narrowface frame to create circular arcs on the back face and inside face sides, it is possible to unify the size of the unit roll frames, thus resulting in the fact that the number of spares are reduced and leading to a reduction of cost and easier maintenance.

Also according to the present invention, since there are provided means for pivoting the top roller apron and parallel moving means for moving it parallelly toward the back face sides and inside face sides, through the narrow-face frame support portion, it is not necessary to lift the top roller apron and thus it becomes easier to adjust alignment.

Moreover, only a small adjusting force is required for pivoting motion, that is, adjusting operation can be accomplished because pivoting occurs at the intersection of the slab back face and the horizontal center between the top and bottom of the top roller apron. Any pivoting will result in equal adjustments of the top and bottom of the top roller apron.

BRIEF DESCRIPTION OF THE DRAWINGS

Other objects and features of the present invention will become more apparent from the following detailed description of an embodiment of the invention taken in connection with the accompanying drawings, in which.

DESCRIPTION OF THE PREFERRED EMBODIMENTS

Figure 1:
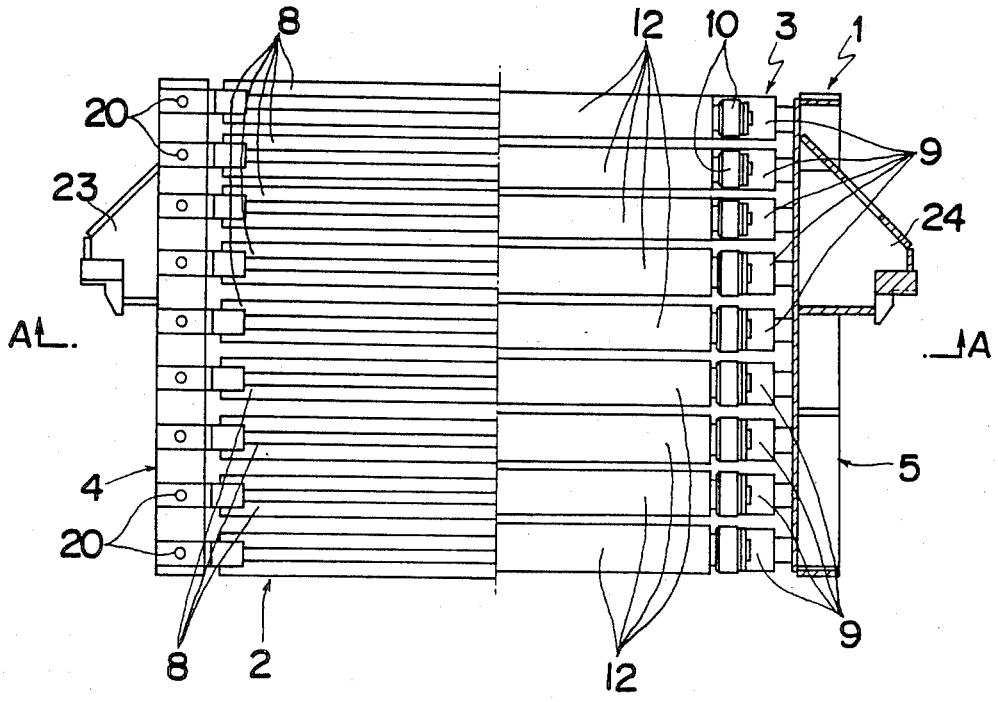
FIG. 1 is a front view of a top roller apron in a continuous casting assembly.
Figure 2:
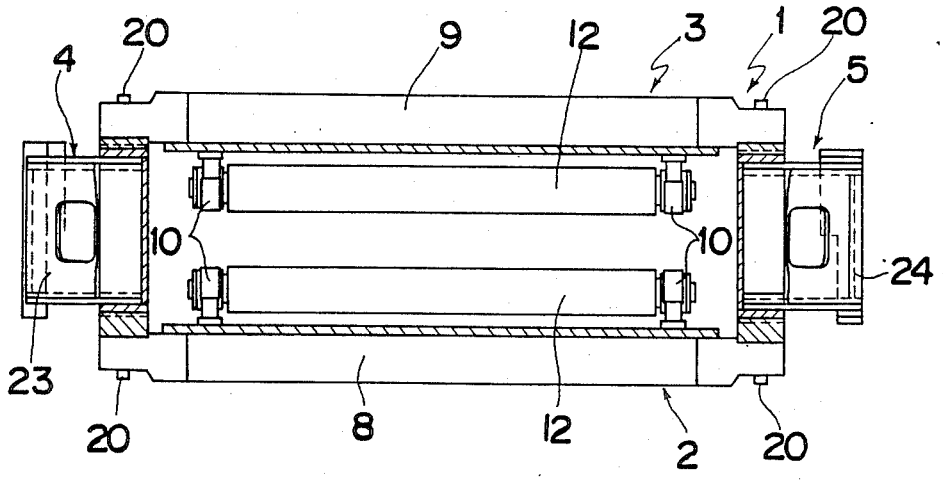
FIG. 2 is a sectional view taken along line A—A of FIG. 1.

As shown in FIGS. 1 to 4, a top roller apron 1 in a continuous casting assembly is composed of a back face frame 2, an inside face frame 3, and a narrow-face frame 4 (i.e. inside radius face) and narrow face frame (i.e. outside radius face) 5. As in the prior art, the paired narrow-face frames 4, 5 are set to a length required for the top roller apron 1. The datum-side wide-face frame 2 is divided into a plurality (e.g. nine) of unit frames 8 for the length required as the top roller apron 1. The inside face frame 3 is also divided into unit frames 9, such being the same number as that of the unit frames 8 of the back face frame 2 for the length required as the top roller apron 1. These unit frames 8, 9 are of the same structure having a T-shaped section for example and a pair of bearing housings 10 are fixed with bolts 11 to portions close to ends of each unit frame. A plurality of rolls 12 are each rotatably supported by the bearing housing 10 at opposite ends thereof and a shim 13 for adjusting the height of each roll 12 is disposed between each bearing housing 10 and each unit frame 8, 9.

Figure 3:
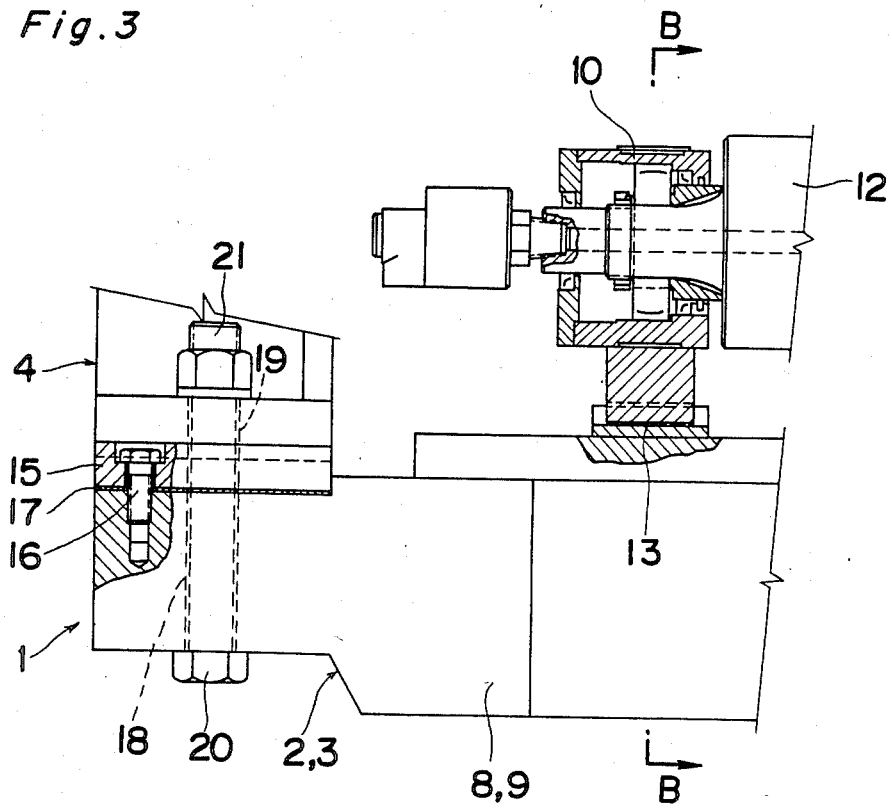
FIG. 3 is a side view of a unit roll frame.
Figure 4:
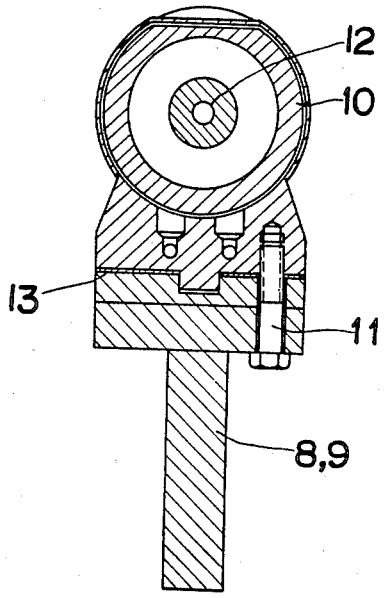
FIG. 4 is a sectional view taken along line B—B of FIG. 3.

As shown in FIG. 3, each end portion of each unit frame 8, 9 is so extended as to reach a side wall of the narrow-face frame 4 and a block 15 is fixed thereto with a bolt 16. The blocks 15 are for creating a curve along the casting direction and are different in thickness. Between each block 15 and each unit frame 8, 9 is disposed a shim 17 for adjusting the height of the block 15. In each end portion of each unit frame 8, 9 is formed a bolt hole 18 which extends through the end portion and the block 15, and in a side wall of each of the paired narrow-face frames 4, 5 is formed a bolt hole 19 coincident with each bolt hole 18 formed in each of the unit frames 8, 9 which are arranged in series at predetermined intervals in the casting direction. The unit frames 8, 9 are each individually attached to the paired narrow-face frames 4, 5 with bolts 20 inserted through the bolt holes 18, 19 and nuts 21. The blocks 15 are interposed between each unit frame 8, 9 and the side wall of the frame 4, 5 to align the unit frames 8, 9 in the casting direction, thereby permitting the unit frames to have a common structure.

Thus according to the above construction, the back side face and inside face frames 2,3 are supported by the paired narrow-face frames 4,5, which in turn are provided with support portions 23, 24 on the respective outer surfaces for their support by the equipment body.

The following description is provided regarding the operation of the top roller apron 1 in the continuous casting assembly.

The back side face and inside face frames 2, 3 are constituted by attaching the unit frames 8, 9 which support the rolls 12 to the paired narrow-face frames 4, 5 in series with bolts 20, 21. Therefore, when it becomes necessary to change a roll, the unit frame 8, 9 which supports the roll 12 to be replaced can be taken out by removing the bolts 20 and nuts 21 without disassembling all the frames 2–5, and thus it is possible to effect roll replacement for each unit frame 8, 9.

Figure 5:
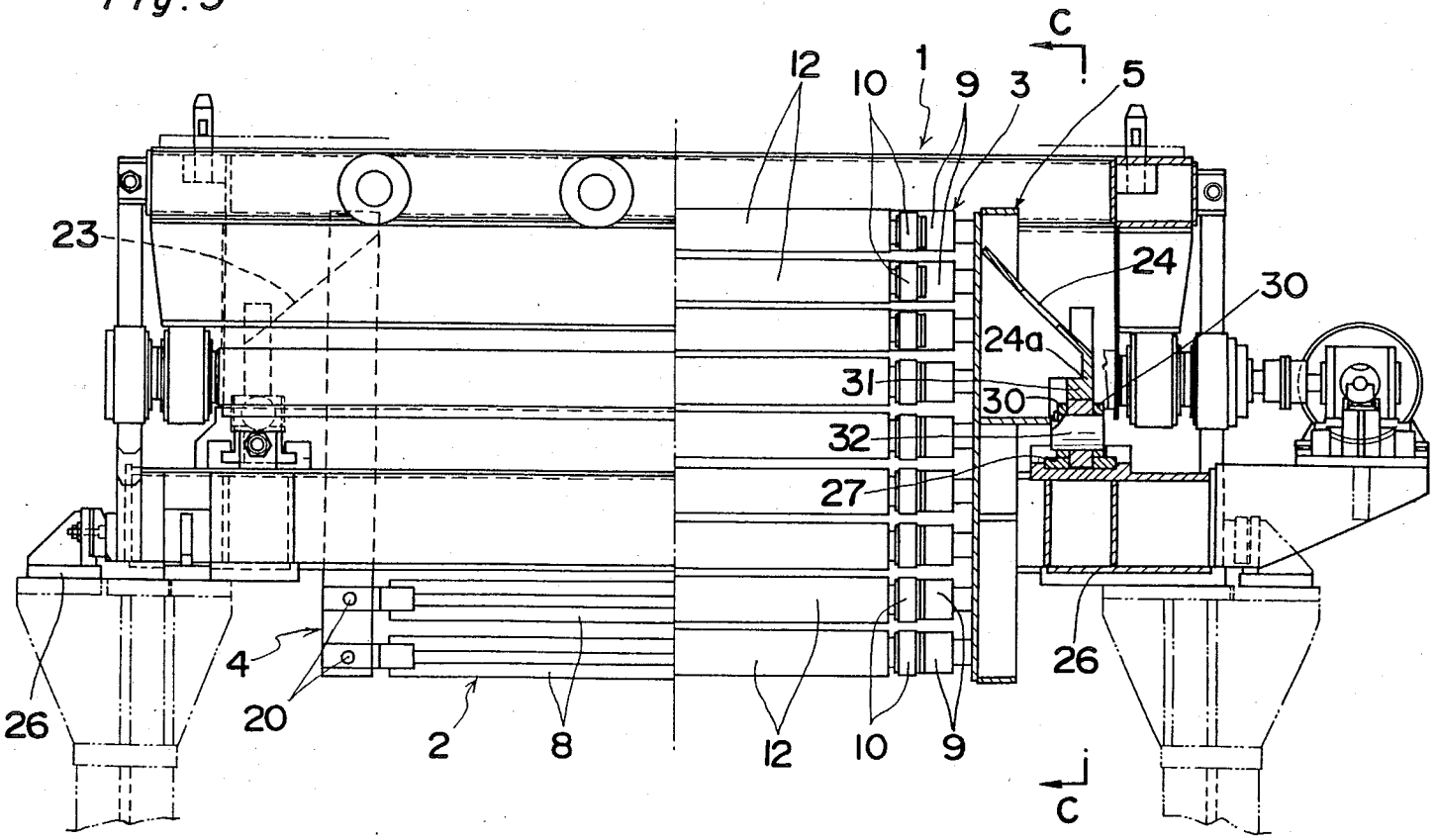
FIG. 5 is a front view showing a support structure for the top roller apron in a continuous casting assembly.
Figure 6:
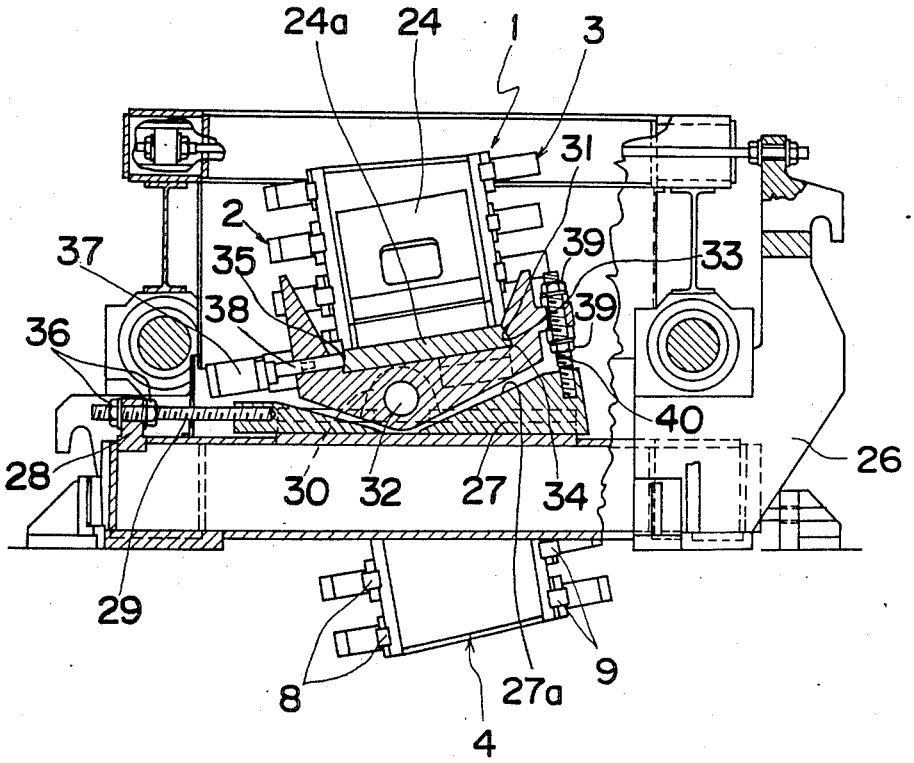
FIG. 6 is a sectional view taken along line C—C of FIG. 5.

FIGS. 5 and 6 illustrate a preferred support structure for the roller apron 1. As previously noted, the roller apron 1 is composed of the back side face and inside face frames 2, 3 and the paired narrow-face frames 4, 5. The narrow-face frames 4, 5 are supported by mold oscillation bases 26 through support portions 23, 24 which are provided on the outer surfaces of the narrow-face frames 4,5. The bases 26 are each provided with a slide base 27 which is movable toward the back face and inside face sides. The slide base 27 is formed with a tapped hole along its moving direction and a parallel moving screw 29 is threadedly fitted in the tapped hole, the parallel moving screw 29 being mounted to a bracket 28 of the bases 26 with double nuts 36. Nuts 36 are rotated to effect horizontal movement of screw 29. The slide base 27 is moved horizontally toward the back face side and inside face sides as the parallel moving screw 29 is operated for extension and withdrawal of slide base 27. A V-shaped receiving portion **27*a* having a large opening angle is provided on the slide base 27 and a pair of brackets 30 are provided on both sides of the bottom of the receiving portion 27*a*. Further, a generally tapered support frame 31 is fitted in the receiving portion 27*a* between the brackets 30 and is easily pivotably supported by a pivot pin 32 at a predetermined position because, as previously mentioned, pivoting occurs at the intersection of the slab back face and the horizontal center between the top and bottom of a top roller apron. In the groove portion of the support frame 31 is fitted a stepped portion 24*a* (indicated only with respect to the support portion 24 in FIGS. 5, 6) of the support portion 23, 24 of each narrow-face frame 4, 5. One side edge of the support portion 23, 24 is formed with a tapered surface 34 adapted to fit in a tapered groove 33 formed in the groove portion of the support frame 31. An opposite side edge of the support portion 23, 24 is also formed with a tapered surface 35**.

A cylinder 37 is fixed to one end portion of the support frame 31 and by abutment of a piston rod 38 of the cylinder 37 with the tapered surface 35 of the support portion 23, 24 the support portion 23, 24 is locked relative to the support frame 31.

A screw 40 is mounted with double nuts 39 to the other end portion of the support frame 31 and it is threadedly fitted in a tapped hole formed in the other end portion of the slide base 27, the tapped hole being tapped upwardly. Nuts 39 are rotated to effect relative motion of screw 40. By extending and withdrawing the screw 40 relative to the support frame 31, the support frame 31 is pivoted in a vertical plane about the pivot pin 32.

The operation of the support structure for the top roller apron in the continuous casting assembly will be described below.

The support frame 31 pivoted as the screw 40 moves so as to be extended or withdrawn relative frame 31, so that the top roller apron 1 is pivoted through the support portions 23, 24 of the narrow-face frames 4, 5 so as to allow for pivoting without shifting. Further, as the parallel moving screw 29 is operated for extension or withdrawal relative to fixed frame 28, the support frame 31 is moved horizontally together with the slide base 27, without pivoting so that the top roller apron 1 is moved horizontally toward the back face side or inside face side through the support portions 23, 24 of the narrow-face frames 4, 5.

It goes without saying that the above top roller apron support structure is also applicable to top roller aprons having the conventional structure in which wide-face frames are formed integrally.

Although one embodiment of the present invention has been described in detail, it is to be understood that the invention is not limited thereto and that such modifications and alterations as can be easily effected by those skilled in the art are included in the invention within the scope of the technical concept described in the scope of the appended claims.

What is claimed as new and desired to be secured by Letters Patent of the United States is:

1. A top roller apron assembly in a continuous casting assembly, comprising:

a pair of narrow-face frames having a first and second side;

a back face side frame which comprises a plurality of first unit roll frames connected to said first side of said narrow-face frames;

an inside face side frame which comprises a plurality of second unit roll frames connected to said second side of said narrow face frames;

a plurality of rolls mounted side by side on each of said side frames wherein each unit roll frame supports a single roll of said plurality of rolls;

means for removably attaching opposite end portions of each of said unit roll frames to side wall portions of said pair of narrow-face frames; and a main frame wherein a support portion for supporting each of said narrow-face frames to said main frame is mounted on said main frame, and means mounted for pivoting said narrow-face frames about a fulcrum portion of said support portion and wherein said support portion further comprises an open faced slide base having a V-shaped receiving portion and movable towards the back face side and inside face side and a tapered support frame having a V-shaped surface mounted on said V-shaped receiving portion mounted on said open faced slide base and pivotably supported through a pivot pin.

2. A top roller apron in a continuous casting assembly according to claim 1, wherein said unit roll frames are all formed of the same shape.

3. A top roller apron assembly in a continuous casting assembly according to claim 2, further comprising spacing adjusting means disposed between each of said unit roll frames and each of said side frames.

4. A top roller apron in a continuous casting assembly according to claim 1 further comprising a main frame wherein a support portion for supporting each of said narrow-face frames to said main frame is mounted on said main frame, parallel moving means for moving the top roller apron horizontally toward the back face and inside face sides relative to said support portion, and means for pivoting the top roller apron about a fulcrum portion of said support portion.

5. A top roller apron assembly in a continuous casting assembly, comprising:

a pair of narrow-face frames having a first and second side;

a main frame;

a back face side frame connected to said first side of said narrow-face frame;

an inside face side frame connected to said second side of said narrow-face frame;

a plurality of rolls mounted side by side to each of said side frames;

a support portion provided on said main frame for supporting said narrow-face frames to said main frame; and means for pivoting the top roller apron about a fulcrum portion of said support portion wherein said support portion further comprises an open faced slide base having a V-shaped receiving portion and movable toward the back face side and inside face side and a tapered support frame having a V-shaped surface mounted on said V-shaped receiving portion mounted on said open faced slide base and pivotably supported through a pivot pin.

6. A top roller apron assembly in a continuous casting assembly according to claim 5, wherein said support portion further comprises a receiving portion for receiving thereon portions of said narrow-face frames to be supported, and means for locking the portions of said narrow-face frames to be supported so as to be immovable with the main frame.

7. A top roller apron assembly in a continuous casting assembly according to claim 5, further comprising a cylinder and piston rod connected to said slide base for locking said narrow face support frame to said slide base.

8. A top roller apron assembly in a continuous casting assembly according to claim 5, further comprising a screw shaft wherein said slide base and said support frame are interconnected by said screw shaft.

* * * * *